US009472078B2

(12) United States Patent
Pandey

(10) Patent No.: US 9,472,078 B2
(45) Date of Patent: Oct. 18, 2016

(54) METHOD AND APPARATUS FOR INTEGRATION OF ELECTRICAL FIRE SENSOR WITH FIRE PANEL

(71) Applicant: Honeywell International Inc., Morristown, NJ (US)

(72) Inventor: Pankaj Kumar Pandey, Bangalore (IN)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 40 days.

(21) Appl. No.: 14/589,590

(22) Filed: Jan. 5, 2015

(65) Prior Publication Data

US 2016/0196730 A1 Jul. 7, 2016

(51) Int. Cl.

| | |
|---|---|
| ***G08B 21/00*** | (2006.01) |
| ***G08B 17/06*** | (2006.01) |
| ***G08B 21/18*** | (2006.01) |

(52) U.S. Cl.

CPC ..... *G08B 17/06* (2013.01); *G08B 21/185* (2013.01)

(58) Field of Classification Search

CPC ..... G08B 17/06; G08B 21/185
USPC ..... 340/650
See application file for complete search history.

(56) References Cited

U.S. PATENT DOCUMENTS

| | | | | |
|---|---|---|---|---|
| 2,667,630 | A * | 1/1954 | Jorgensen | G08B 17/06 340/515 |
| 3,044,050 | A * | 7/1962 | Abromaitis | A62C 3/08 340/514 |
| 3,188,434 | A * | 6/1965 | Numayama | G08B 17/06 200/83 N |
| 3,594,751 | A * | 7/1971 | Ogden | G08B 17/06 340/509 |
| 6,577,484 | B1 | 6/2003 | Macbeth et al. | |
| 8,237,577 | B2 * | 8/2012 | Albert | G08B 1/08 340/635 |
| 2014/0071564 | A1 | 3/2014 | Kim | |
| 2014/0084942 | A1 | 3/2014 | Logvinov et al. | |

FOREIGN PATENT DOCUMENTS

| | | | |
|---|---|---|---|
| JP | 2013-250258 | A | 12/2013 |
| KR | 10-2012-0137623 | A | 12/2012 |
| KR | 10-2013-0096406 | A | 8/2013 |
| KR | 10-2013-0101427 | A | 9/2013 |

OTHER PUBLICATIONS

English language translation of abstract of JP 2013-250258.
English language translation of abstract of KR20120137623 (A).
English language translation of abstract of KR20130096406 (A).
English language translation of abstract of KR20130101427 (A).

* cited by examiner

*Primary Examiner* — Juan A Torres
(74) *Attorney, Agent, or Firm* — Husch Blackwell LLP

(57) ABSTRACT

A method and apparatus are provided including a current detector monitoring an electrical conductor supplying power to a geographic area for shorts, arcing or overloads, the current detector detecting a short, arc or overload on the electrical conductor, and a fire alarm panel adjusting a sensitivity of a fire detector within the geographic area in response to the detected short, arc or overload.

20 Claims, 3 Drawing Sheets

METHOD AND APPARATUS FOR INTEGRATION OF ELECTRICAL FIRE SENSOR WITH FIRE PANEL

FIELD

This application relates to security systems and, more particularly, to fire detection systems.

BACKGROUND

Systems are known to protect people and assets within secured areas. Such systems are typically based upon the use of one more sensors that detect threats within the secured area.

Threats to people and assets may originate from any of a number of different sources. For example, an intruder may rob or injure occupants who are present within the area. Alternatively, a fire may kill or injure occupants who become trapped by a fire in a home. Similarly, carbon monoxide from a fire may kill people in their sleep.

In order to detect threats, one or more sensors may be placed throughout a home. For example, intrusion sensors may be placed on the doors and/or windows of a home. Similarly, smoke detectors may be placed in a kitchen or other living areas. Alternatively, or in addition, carbon monoxide detectors may be placed near sleeping areas.

In most cases, threat detectors are connected to a local control panel. In the event of a threat detected via one of the sensors, the control panel may sound a local audible alarm. The control panel may also send a signal to a central monitoring station.

Located on the control panel or nearby may be a display screen that displays the status of the fire and/or security system. In addition to displaying status, the display may also provide an indication of the location of any activated intrusion or fire sensors.

While local security systems work well, they may not always offer enough advance warning especially in the case of fast developing fires. Accordingly, a need exists for better methods of detecting fires.

DETAILED DESCRIPTION

Figure 1:
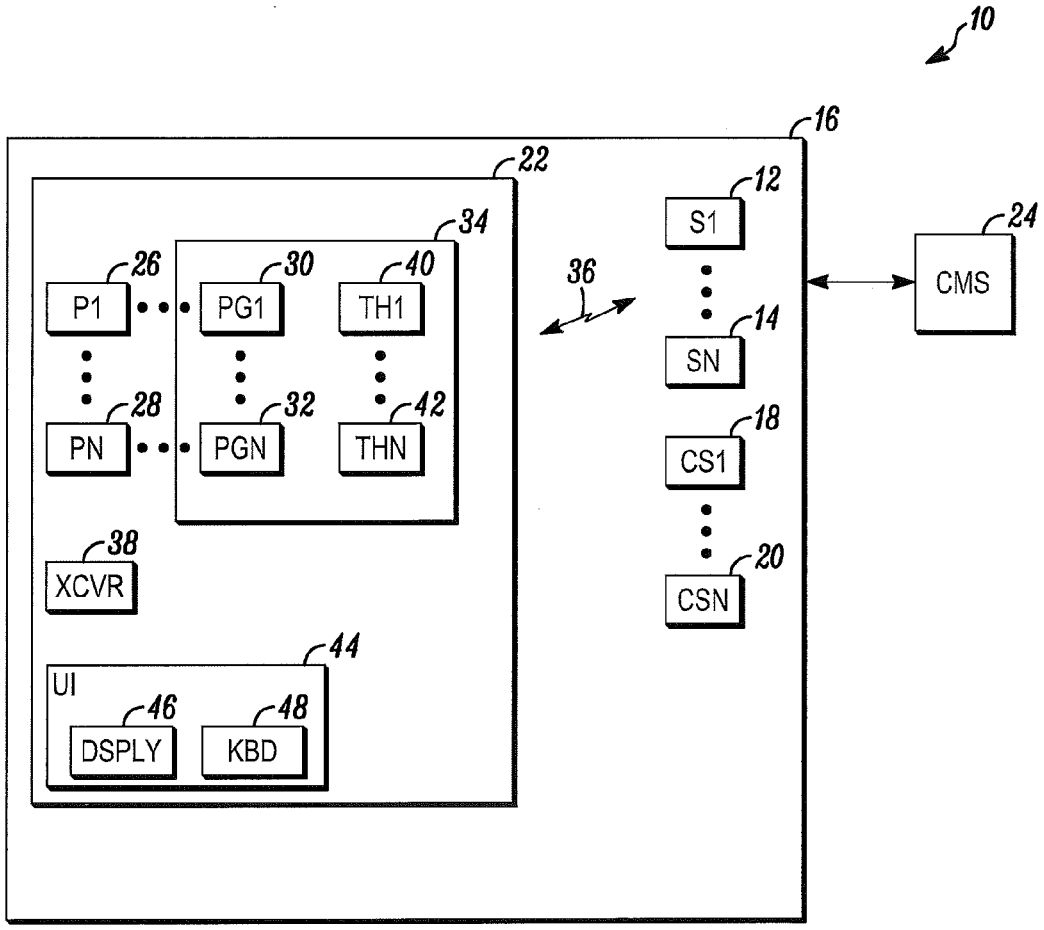
FIG. 1 illustrates a block diagram of a security system in accordance herewith.

While disclosed embodiments can take many different forms, specific embodiments thereof are shown in the drawings and will be described herein in detail with the understanding that the present disclosure is to be considered as an exemplification of the principles thereof as well as the best mode of practicing the same and is not intended to limit the application or claims to the specific embodiment illustrated.

FIG. 1 is a simplified block diagram of a security system (e.g., a fire detection system) 10 shown generally in accordance with an illustrated embodiment. Included within the system are a number of sensors 12, 14 that detect threats within a predetermined, secured geographic area 16.

The sensors may be based upon any of a number of different technologies. For example, one or more of the sensors may be limit switches placed on the doors and/or windows providing access into and egress from the secured area. The sensors may also include one or more motion detection devices placed within an interior of the secured area that detect intruders who have been able to circumvent the doors and/or window sensors. Alternatively, one or more of the sensors may be fire detectors (e.g., smoke detectors, carbon monoxide detectors, heat detectors, etc.).

Also included within the secured area may be one or more current sensors 18, 20. The current sensors detect electrical current flowing from a local electrical utility company into one or more portions or subareas of the secured area.

The sensors may be monitored by a control panel (e.g., a fire panel) 22. Upon detection of one of the threat sensors, the control panel may compose and send an alarm message to a central monitoring station 24. The central monitoring station may respond by summoning the appropriate help (e.g., the police department, the fire department, etc.).

A user interface 44 may provide an indication of the detected threat on a display 46. A human user may acknowledge the threat via a keyboard 48.

The sensors are coupled to the control panel via a communication medium 36. The communication medium may be a signaling loop circuit (SLC) or a wireless connection. In the case where the medium is a signaling loop circuit, the loop may consist of two electrical conductors extending outwards from the control panel to the sensors. Each of the sensors is connected in parallel across the two wires of the loop.

In the case where the medium is wireless, each of the sensors and the control panel has a wireless transceiver 38. In this case, each of the sensors may set up a communication link with the control panel through its respective transceiver.

Included within the control panel and each of the sensors may be one or more processor apparatus (processors) 26, 28 each operating under control of one or more computer programs 30, 32 loaded from a non-transitory computer readable medium (memory) 34. As used herein, reference to a step performed by a computer program is also reference to the processor that executed that step.

In general, each of the sensors and the control panel has its own unique system address. Under one illustrated embodiment, a polling processor within the control panel may periodically poll each of the sensors. Alternatively, a communication processor within each of the sensors may periodically report a status of the sensor to the control panel.

Each of the sensors includes a sensing element that determines a level of a sensed value in an environment of the sensor. In the case of a smoke detector, the sensing element may be a carbon monoxide detector or a smoke detector. The sensed value may be compared by a threshold processor with a threshold value 40, 42.

The threshold processor may be located within the sensor or within the control panel. Where located within the control panel, the sensed value may be read by a sensor processor and transmitted to the control panel through the communication medium where it is compared with the threshold value.

Alternatively, each of the sensors may have its own dedicated processor that reads a magnitude of the sensed value from the sensor element and locally compares the read value with a threshold value. If the read value exceeds the threshold value, then the processor reports the occurrence to an alarm processor within the control panel.

Under one illustrated embodiment, each of the smoke detectors may have first and second threshold values used for triggering an alarm or a pre-alarm. One of the threshold values is of a smaller relative magnitude and is used in conjunction with electrical faults detected within an area proximate the smoke detector to trigger a pre-alarm that notifies occupants of the potential for a fire.

Each of the current detectors may have at least three associated threshold values. One of the threshold values indicates an overload, a second a short circuit and a third is a time versus current value that indicates arcing.

In general, electrical fires are one of the most serious forms of electrical accidents in high occupancy buildings, such as hotels, commercial complexes, IT companies, etc. A fire due to a short circuit/overloading/arcing is among the most common electrical mishap. Fires can result in not only loss to property, but also to human life.

The system shown in the figures integrates an electrical fire (e.g., current) sensor with a fire panel. The fire panel receives an indication of electrical trouble, such as short circuits, overloading and/or arcing and, in response, provides a pre-alarm indication to a user using a dedicated pre-alarm LED provided on the fire panel.

For short circuits and arcing, the fire panel acts immediately and reduces a threshold value for corresponding smoke sensors to sense any fire at an early stage and report back such trouble to the fire panel. The panel can record such trouble as a pre-alarm situation.

In many cases, an electrical fire sensor is installed after a circuit breaker for each floor of a building in order to monitor for any electrical malfunctions. When any of a number of different malfunctions, such as a short circuits, current overloading, or arcing occurs, the current sensor sends a trouble indication back to the fire panel (for example, via a dedicated SLC communication connection), and the panel records such trouble as a pre-alarm indication. For a fault, such as short circuits and arcing, the fire panel will act immediately to increase the sensitivity level of smoke sensors to sense any fire in an early stage and report such incidence to the fire panel as a pre-alarm message. The system will return to normal if no repeat incidents happen within a configured time, and the smoke alarm threshold is restored to its original value.

In this regard, the secured area may be divided into a number of portions or subareas based upon a source of electrical power to the area. For example, electrical power from a local power utility may be supplied to a main power panel of the secured area. A respective branch circuit (circuit breaker) may supply power to each of the subareas. For example, the secured area may be comprised of a building with many floors and a circuit breaker allocated for each floor.

Each of the branch circuits may be monitored for faults (e.g., short circuits, electrical arcing, overloads, etc.). Upon detecting an electrical fault, a sensitivity of a fire detector in the area of the electrical fault may be adjusted to detect fires resulting from the electrical fault.

In this regard, a contact-less electrical fire (current and/or voltage spike) sensor is installed on AC feeds capable of detecting faults (e.g, short circuits, overloading or arcing) and able to communicate (via an SLC connection) to the fire panel in order to detect any events of electrical malfunction. Each of the smoke sensors (installed in fire prone areas) is logically mapped to an electrical fire sensor in such a way that, whenever critical events, such as short circuits occur, the fire panel will send a command to mapped smoke sensors to increase their sensitivity in order to catch any events of smoke and log such smoke events as pre-alarm alerts to indicate to a user the possibility of any unusual smoke activity.

Figure 2:
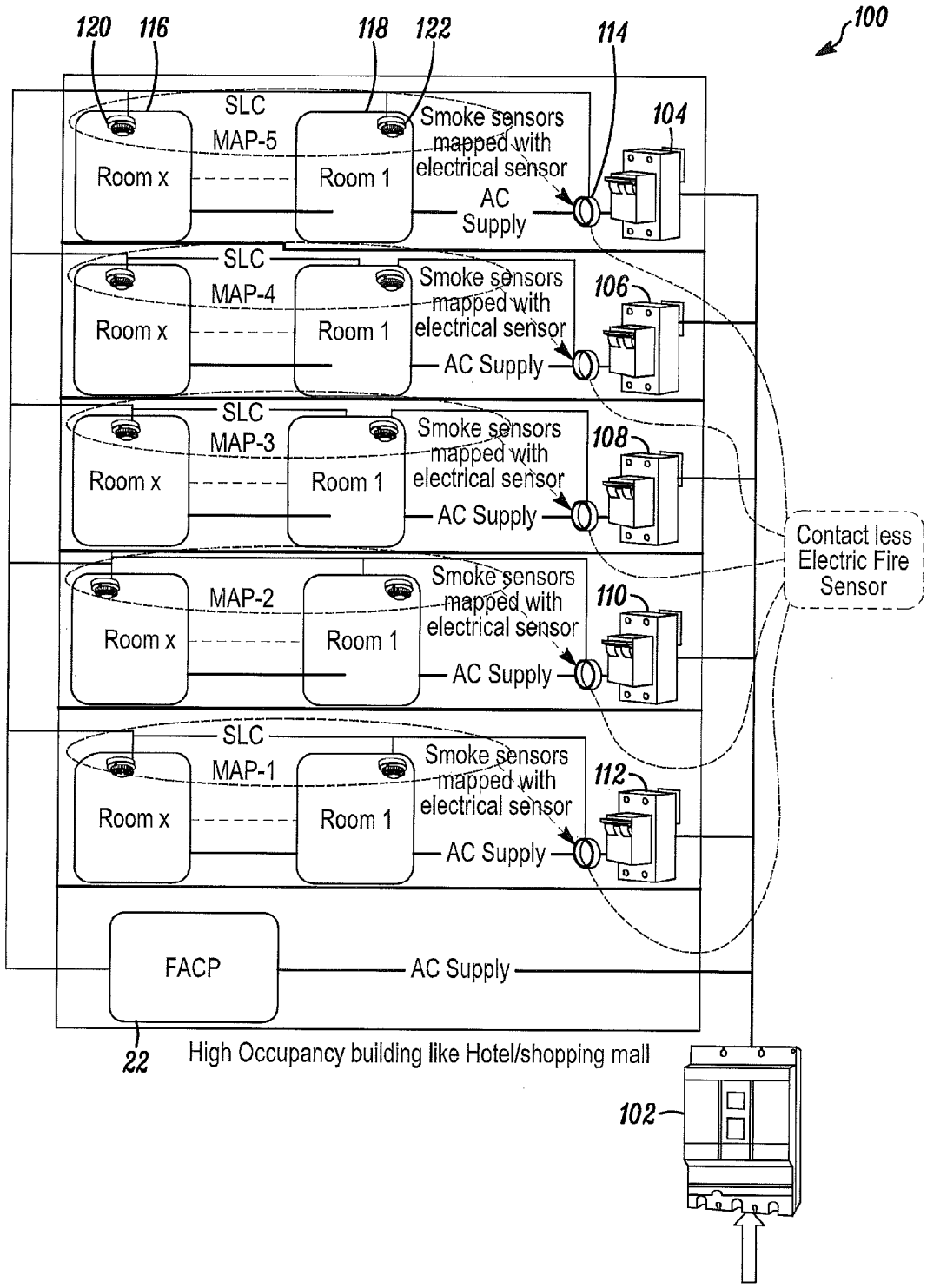
FIG. 2 is a schematic of an electrical distribution system used within the security system.

FIG. 2 is a simplified schematic of an electrical system 100 of the secured area. Included within the system is a main breaker 102 that supplies power to a number of branch circuit breakers 104, 106, 108, 110, 112 and branch circuits.

As illustrated in FIG. 2, the first breaker 104 supplies electrical power to a first subarea including a room x (labeled 116) and room 1 (labeled 118). A first fire detector 12, 14 (labeled 120 in FIG. 2) monitors room x for fires. A second fire detector 12, 14 (labeled 122 in FIG. 2) monitors for fires in room 1. A respective current sensor 18, 20 (labeled 114 in FIG. 2) monitors the electrical power flowing into the first subarea. The second, third, fourth and fifth subareas and corresponding fire detectors, current sensors and breakers are arranged in a similar manner.

The current sensor (e.g., current sensor 114) of each subarea (e.g., subareas 116, 118) is mapped to the corresponding fire detectors (e.g., fire detectors 120, 122). Mapping means that the system address of the current detector in an area is associated with the corresponding fire detectors that protect that area.

Figure 3:
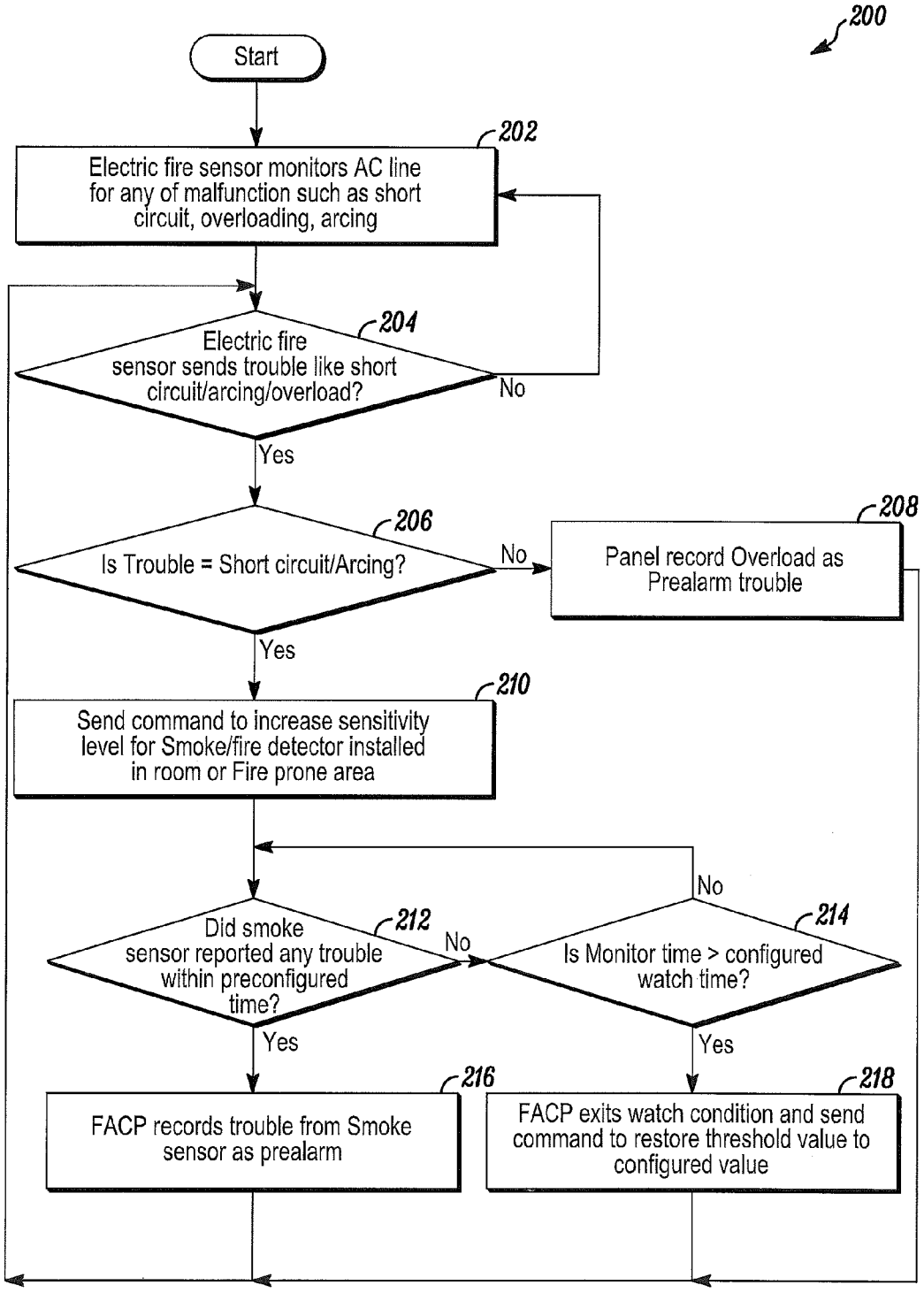
FIG. 3 is a flow chart of steps used by the security system.

FIG. 3 is a flow chart 200 of current monitoring and sensitivity adjustment of the fire detectors within the secured area. As shown, a fault processor monitors 202 a current sensor of each subarea for electrical faults. If a fault is detected by the fault processor, then the fault processor sends a fault indication to a threshold processor of each corresponding fire detector serving the area. The fault indication may be used to identify 204 any of three possible threshold values, including a first value for arcing, a second value for short circuits and a third value for overloads.

A threshold processor may receive the fault indicator and determine 206 the type of fault from the fault indication. If the fault indication is not a short circuit or arcing, then the threshold processor may simply activate 208 an electrical trouble indicator on the display associated with the subarea and/or corresponding fire detector(s).

Alternatively, if the threshold detector should determine that the fault is arcing or a short circuit, then the threshold detector adjusts a sensitivity of any fire detectors within the area of the fault. In this case, the threshold detector sends 210 a message to a fire detector processor instructing the fire detector processor to adjust a sensitivity of the fire detectors in the area. In this case, the adjustment reduces the threshold value used for detecting a fire within the area.

In addition to adjusting the threshold values of the fire detectors in the area, the threshold detector also activates a timer (with a corresponding timer threshold or a preconfigured watch time) that determines a time since the last incidence of arcing and/or short circuiting. After each incidence of arcing or shorting, a fault processor compares 214 the elapsed time with the configured time. If the elapsed time since the last arcing or shorting fault has exceeded the watch time, then the fault processor exits 218 the watch condition.

On the other hand, if the fire detector detects 212 a fire based upon the reduced threshold value, then a processor of the fire detector reports 216 the fire as a pre-alarm indication of fire on the display of the user interface. This may be displayed on the display along with an identifier of the fire detector, the area of the detected fault and an indication that such detection is a pre-alarm indicator of the possibility of a fire. This allows any person viewing the display to investigate and correct the situation causing the electrical fault.

In general, the system includes an apparatus that includes a current detector monitoring an electrical conductor supplying power to a geographic area for shorts, arcing or overloads, the current detector detecting a short, arc or overload on the electrical conductor, and a fire alarm panel adjusting a sensitivity of a fire detector within the geographic area in response to the detected short, arc or overload.

Alternatively, the system includes a current detector that monitors an electrical conductor supplying power to a geographic area for shorts, arcing or overloads, a processor of a fire alarm panel that detects a short, arc or overload on the electrical conductor based upon a monitored current of the current detector, and a processor of the fire alarm panel that adjusts a sensitivity of a fire detector within the geographic area in response to the detected short, arc or overload.

Alternatively, the system includes a control panel of a security system that detects fires within a predetermined geographic area having a plurality of subareas, a respective current detector of the control panel for each of the plurality of subareas that monitors a respective electrical conductor supplying power to a respective subarea in the plurality of subareas for shorts, arcing or overloads, a respective fire detector associated with each of the plurality of subareas, a processor of a fire alarm panel that detects a short, arc or overload on an electrical conductor of one of the plurality of subareas based upon a monitored current from the respective current detector of the one of the plurality of subareas, and a processor of the fire alarm panel that adjusts a sensitivity of the respective fire detector of the one of the plurality of subareas in response to the detected short, arc or overload.

From the foregoing, it will be observed that numerous variations and modifications may be effected without departing from the spirit and scope hereof. It is to be understood that no limitation with respect to the specific apparatus illustrated herein is intended or should be inferred. It is, of course, intended to cover by the appended claims all such modifications as fall within the scope of the claims. Further, logic flows depicted in the figures do not require the particular order shown, or sequential order, to achieve desirable results. Other steps may be provided or steps may be eliminated from the described flows, and other components may be added to or removed from the described embodiments.

The invention claimed is:

1. A method comprising:

a current detector monitoring an electrical conductor supplying power to a geographic area for shorts, arcing or overloads;

the current detector detecting a short, arc or overload on the electrical conductor; and a fire alarm panel adjusting a sensitivity of a fire detector within the geographic area in response to the detected short, arc or overload.

2. The method as in claim 1 further comprising dividing the geographic area into a plurality of subareas, wherein each of the plurality of subareas includes a respective branch electrical circuit providing electrical power to the geographic area.

3. The method as in claim 1 further comprising activating an audible alarm within the geographic area.

4. The method as in claim 1 further comprising activating a pre-alarm annunciator on the fire alarm panel.

5. The method as in claim 1 wherein adjusting the sensitivity further comprises reducing a threshold level of fire detection.

6. The method as in claim 2 further comprising providing a respective fire detector in a plurality of fire detectors for each of the plurality of subareas.

7. The method as in claim 6 further comprising the fire alarm panel correlating each of a plurality of current detectors with the respective fire detector in the plurality of fire detectors.

8. The method as in claim 7 wherein the step of the fire alarm panel adjusting the sensitivity of the fire detector within the geographic area further comprises the fire alarm panel adjusting the sensitivity of each of the plurality of fire detectors in response to detection of the short, arc or overload by a respective current detector in the plurality of current detectors on the respective branch electrical circuit.

9. The method as in claim 8 further comprising providing a respective pre-alarm display associated with the adjusted sensitivity for each of the plurality of fire detectors.

10. An apparatus comprising:

a current detector that monitors an electrical conductor supplying power to a geographic area for shorts, arcing or overloads;

a processor of a fire alarm panel that detects a short, arc or overload on the electrical conductor based upon a monitored current of the current detector; and a processor of the fire alarm panel that adjusts a sensitivity of a fire detector within the geographic area in response to the detected short, arc or overload.

11. The apparatus as in claim 10 wherein the geographic area further comprises a plurality of areas or subareas, and wherein each of the plurality of areas or subareas includes a respective branch electrical circuit providing electrical power to the geographic area.

12. The apparatus as in claim 10 further comprising an audible alarm within the geographic area activated by the fire alarm panel.

13. The apparatus as in claim 10 further comprising a pre-alarm annunciator on the fire alarm panel activated by the fire detector at the adjusted sensitivity.

14. The apparatus as in claim 11 wherein the fire detector further comprises a plurality of fire detectors including a respective fire detector in the plurality of fire detectors for each of the plurality of areas or subareas.

15. The apparatus as in claim 14 further comprising a file saved within a memory of the fire alarm panel that correlates each of a plurality of current detectors with the respective fire detector in the plurality of fire detectors.

16. The apparatus as in claim 15 wherein the processor of the fire alarm panel that adjusts the sensitivity of the fire detector within the geographic area further comprises one or more processors of the fire alarm panel that adjusts a respective sensitivity of each of the plurality of fire detectors in response to detection of the short, arc or overload by a respective current detector in the plurality of current detectors on the respective branch electrical circuit.

17. The apparatus as in claim 16 wherein the fire alarm panel further comprises a respective pre-alarm display associated with the adjusted sensitivity for each of the plurality of fire detectors.

18. An apparatus comprising:

a control panel of a security system that detects fires within a predetermined geographic area having a plurality of subareas;

a respective current detector of the control panel for each of the plurality of subareas that monitors a respective electrical conductor supplying power to a respective subarea in the plurality of subareas for shorts, arcing or overloads;

a respective fire detector associated with each of the plurality of subareas;

a processor of a fire alarm panel that detects a short, arc or overload on the respective electrical conductor of one of the plurality of subareas based upon a monitored current from the respective current detector of the one of the plurality of subareas; and a processor of the fire alarm panel that adjusts a sensitivity of the respective fire detector of the one of the plurality of subareas in response to the detected short, arc or overload.

19. The apparatus as in claim 18 wherein the control panel further comprises a display with a respective pre-alarm indicator for each of the plurality of subareas based upon the adjusted sensitivity of the respective subarea.

20. The apparatus as in claim 19 further comprising one of a trouble and smoke indicator based upon one of the detected short, arc or overload.

* * * * *